US006725944B2

(12) United States Patent
Burger et al.

(10) Patent No.: US 6,725,944 B2
(45) Date of Patent: Apr. 27, 2004

(54) MODE SELECTION SWITCH FOR A COMBINATION ELECTRICAL HAND TOOL DEVICE

(75) Inventors: Helmut Burger, Moorenweis (DE); Wolfgang Schreiber, Jengen (DE); Jochen Erhardt, Klosterlechfeld (DE); Peter Gerold, Weilheim (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/453,348

(22) Filed: Jun. 3, 2003

(65) Prior Publication Data

US 2003/0226673 A1 Dec. 11, 2003

(30) Foreign Application Priority Data

Jun. 6, 2002 (DE) ..... 102 25 239

(51) Int. Cl.[7] ..... B25D 16/00
(52) U.S. Cl. ..... 173/48; 173/201; 173/216
(58) Field of Search ..... 173/48, 201, 216, 173/217

(56) References Cited

U.S. PATENT DOCUMENTS 5,664,634 A 9/1997 McCracken
6,015,017 A 1/2000 Lauterwald
6,109,364 A * 8/2000 Demuth et al. ..... 173/48
6,176,321 B1 1/2001 Arakawa et al.
6,192,996 B1 * 2/2001 Sakaguchi et al. ..... 173/48
6,510,903 B2 * 1/2003 Fünfer ..... 173/48
6,557,648 B2 * 5/2003 Ichijyou et al. ..... 173/48

FOREIGN PATENT DOCUMENTS

| | | |
|---|---|---|
| DE | 4216808 | 11/1993 |
| DE | 19716976 | 10/1998 |
| EP | 0437716 | 7/1991 |
| EP | 775555 | 5/1997 |

* cited by examiner

*Primary Examiner*—Scott A. Smith
(74) *Attorney, Agent, or Firm*—Sidley Austin Brown & Wood, LLP

(57) ABSTRACT

A combined electrical hand tool having an operating mode selection switch (1) with additional special functions that can be switched using a displaceable linkage (5) that can be displaced by the operating mode selection switch arranged between a lubricated assembly (2*a*) having a coupling (3*a*) and the external housing (4), wherein in at least two separate lubricant-tight assemblies (2*a*, 2*b*) at least one switchable coupling (3*a*, 3*b*) is present, which can be moved over an outwardly extending actuator (6*a*, 6*b*) that is mounted lubricant-tight.

5 Claims, 2 Drawing Sheets

MODE SELECTION SWITCH FOR A COMBINATION ELECTRICAL HAND TOOL DEVICE

BACKGROUND OF THE INVENTION

Figure 1:
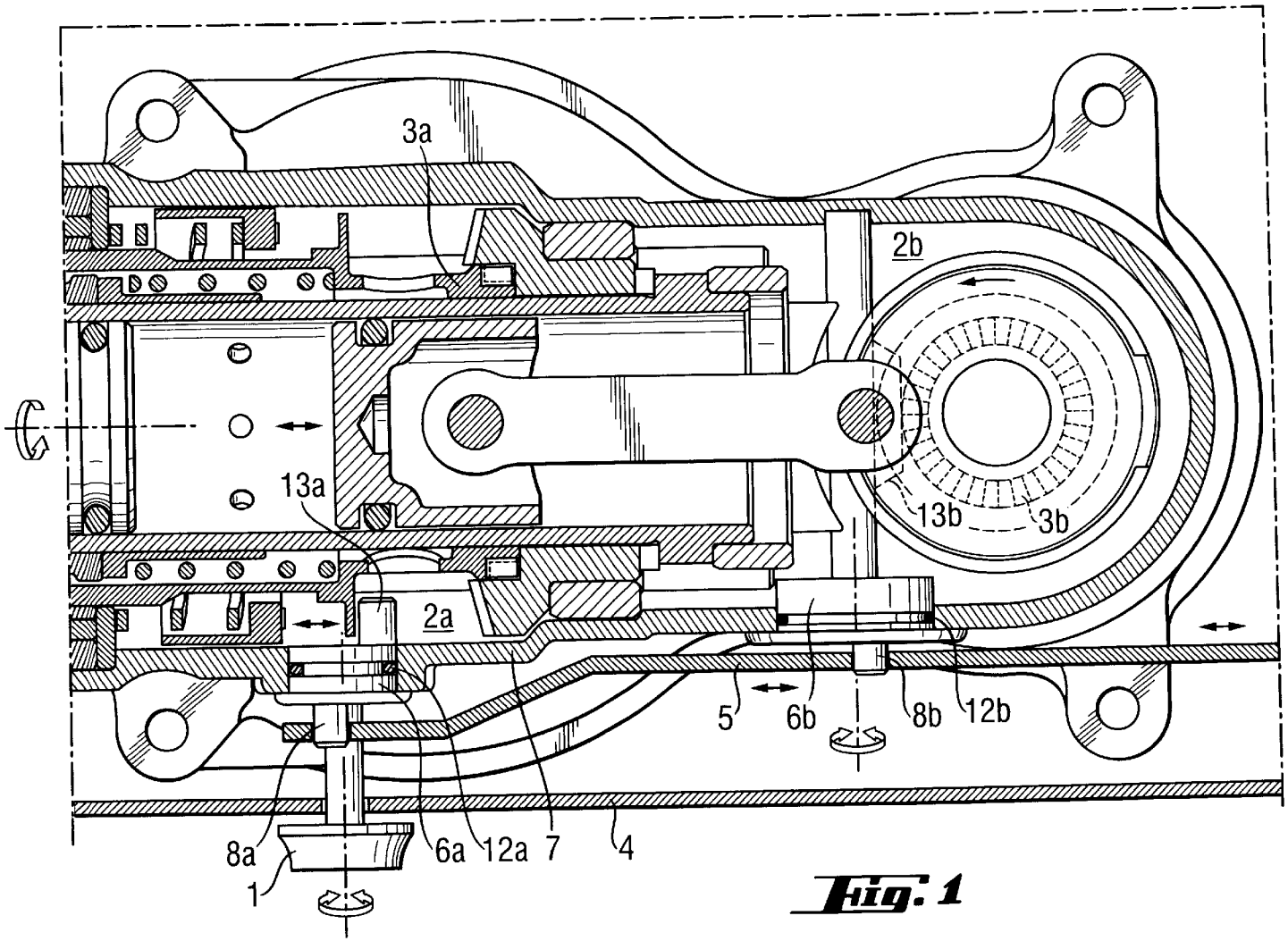

The invention relates to a rotary mode selection switch for an at least partially rotating and/or percussive combination electrical hand tool device, in particular a combination hammer.

According to DE 10031050, in combination hammers, some or all of the operating modes are selected using a manually rotatable operating mode switch: <<rotary drilling>>, <<percussion drilling>>, <<chiseling>>, <<position chisel>> and the driver or percussion mechanism is accordingly combined and mechanically switched. The combination of several switching couplings is made using a switch plate in the lubricated inside of the gearing and percussion assembly.

According to DE 4000822, a rotary operating mode switch with an eccentric pin is sealed to a lubricant between a gearing assembly filled with lubricant grease and the dry outside. All switch functions are done on the inside of the gearing and percussion mechanism assembly.

According to DE 19937767 several operating modes are associated with other electrical and mechanical special functions, which, via a switching linkage arranged between the gearing assembly and the external housing and which is displaceable by the operating mode switch using an eccentric pin, engages in the motor switch, and using a terminal magnet via a Hall sensor, acts upon the control electronics of the drive motor in the motor housing not containing lubricant, which, when in <<chisel>> operation, locks the motor switch and increases the motor speed. There is only one lubricated gearing and percussion mechanism assembly.

SUMMARY OF THE INVENTION

It is the object of the invention to provide an operating mode selection switch for an electrical combination hand-tool with several switchable couplings in at least two different lubricated lubricant-tight gearing and percussion mechanism assemblies, said switch having other special functions.

This object is achieved, essentially, by an electrical combination hand tool having a preferably rotary operating mode selection switch with other special functions that can be switched using a switching linkage arranged between one lubricated assembly with a coupling and the external housing, wherein at least one switchable coupling is present in each of at least two separate lubricant-tight assemblies, each of the assemblies can be displaced using an outwardly extending actuating means mounted lubricant-tight.

The couplings arranged in different assemblies, lubricated with oil and grease, can be combined and switched by the linkage for special functions arranged in the unlubricated intermediate space by virtue of the at least two outwardly extending, lubricant-tight mounted actuating means, both of which are displaceable using the operating mode selection switch or the linkage.

Advantageously, the actuating means is configured as a rotary, lubricant-tight actuating means mounted in an assembly housing, which can be easily seated using O-rings.

Advantageously, the rotary actuating means has an eccentrically arranged eccentric guide pin, which engages in an elongated opening of the linkage, whereby a movement of the linkage can be transformed into a rotation of the rotary actuating means.

Advantageously, a first lubricant-tight assembly is configured as gearing assembly lubricated with grease and a second lubricant-tight assembly is configured as an assembly lubricated with oil, whereby optimal protection against wear is achieved.

Advantageously, a motor switch mediated via the special functions can be mechanically locked via the linkage and/or the motor speed can be changed electronically, whereby the utility of the combination electrical hand tool is enhanced.

BRIEF DESCRIPTION OF THE INVENTION

Figure 2:
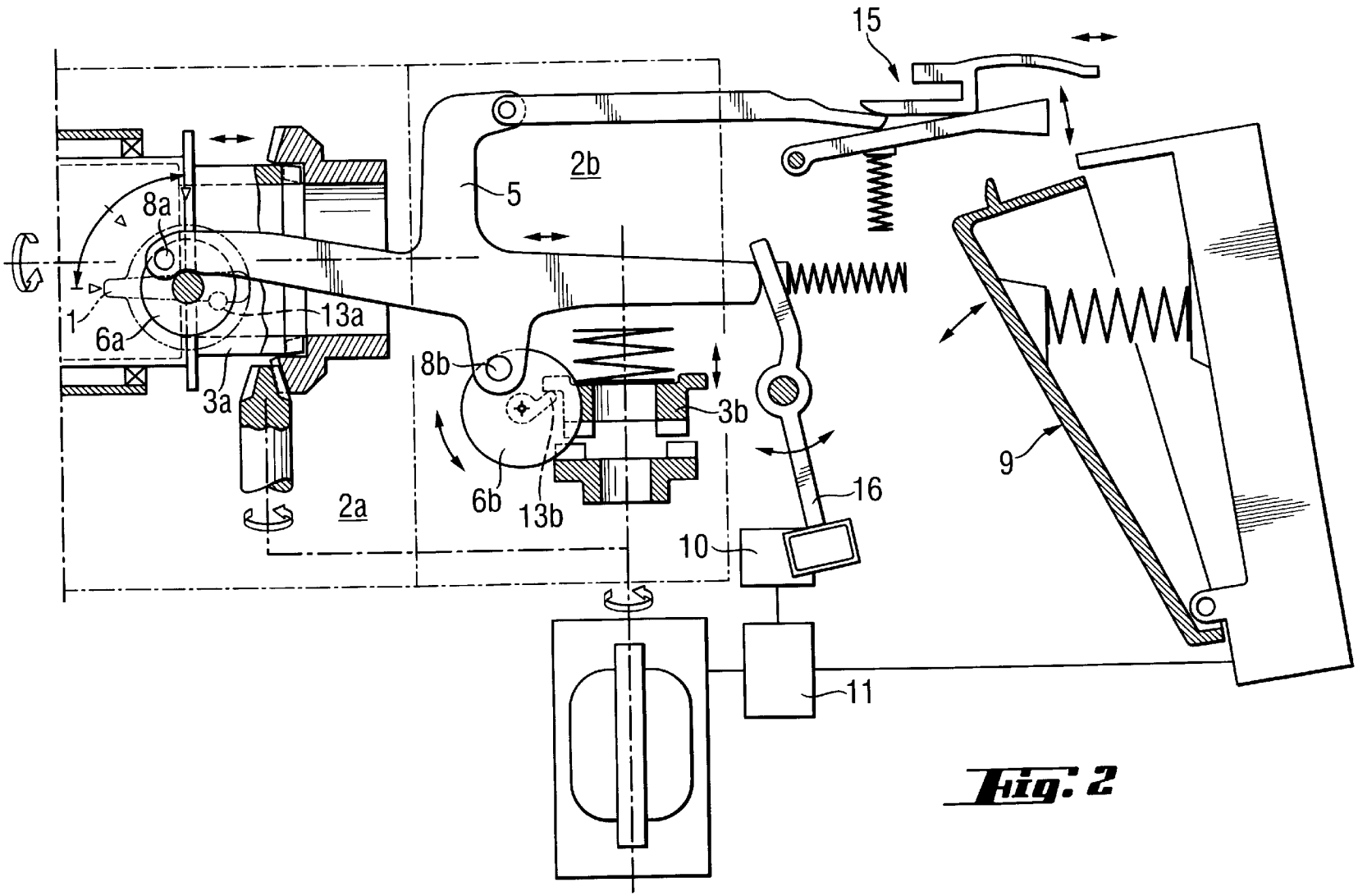

An exemplary embodiment of the invention will be more completely explained with reference to the following drawings wherein:

FIG. 1 shows a combined electrical hand tool according to the invention; and FIG. 2 shows an operating mode selection switch with special functions according to the invention.

DETAILED DESCRIPTION OF THE INVENTION

According to FIG. 1 or FIG. 2, a combined (represented only in part), at least partially rotary and/or striking electrical hand tool has a rotary operating mode selection switch 1. Using the operating mode selection switch 1, a linkage 5, arranged between a lubricated assembly 2 and having a coupling 3*a* and an external housing, can be displaced. A switchable coupling 3*a*, 3*b* is present in each of the two separate lubricant-tight assemblies 2*a*, 2*b*, in the form of a grease lubricated gearing assembly, and an oil-lubricated striking mechanism assembly. The switchable coupling 3*a*, 3*b* can be rotated by an actuating means 6*a*, 6*b* mounted lubricant-tight by O-rings 12*a*, 12*b* and extends external to an assembly housing 7. The actuating means 6*a*, 6*b* are configured with eccentrically arranged eccentric pins 8*a*, 8*b*, which each engage in an opening of the linkage 5 and control projections 13*a*, 13*b* that engage in the couplings 3*a*, 3*b*. The motor speed can be changed using the special functions of the operating mode selection switch 1. Motor switch 9 is mediated using the linkage 5 and mechanically by a locking lever arrangement 15 that can be locked in the switched-on condition and electronically via a contact-less sensor switch 10, in the form of a Hall-switch, controlled by a magnetic rocker 16 and a motor electronics 11.

What is claimed is:

1. A combined electrical hand tool with an operating mode selection switch (1) having further switchable special functions that can be switched by a displaceable switching (5) that can be displaced by the operating mode switch (1) arranged between a lubricated assembly (2*a*) with a coupling (3*a*) and an external housing(4), a switchable coupling (3*a*, 3*b*) is present in each of at least two separate lubricant-tight assemblies (2*a*, 2*b*) and can be displaced using an outward extending actuating means (6*a*, 6*b*) that is mounted lubricant-tight.

2. The electrical hand tool of claim 1, wherein the actuating means (6*a*, 6*b*) is a pivoting rotary actuating means mounted lubricant tight in an assembly housing (7).

3. The electrical hand tool of claim 2, wherein the rotary actuating means has an eccentrically arranged eccentric pin (8*a*, 8*b*) that engages in an elongated opening of the linkage (5).

4. The electrical hand tool of claim 1, wherein a first lubricant-tight assembly (2*a*) is a gearing assembly lubricated with grease and a second lubricant-tight assembly (2*b*) is an oil-lubricated striking mechanism assembly.

5. The electrical hand tool of claim 1, the motor speed can be changed via a special function of the operating mode selection switch (1) and a motor switch (9) can be locked via a sensor switch (10) and a motor electronics (11) using the linkage (5).

* * * * *